US011255101B2

(12) United States Patent
Newman

(10) Patent No.: US 11,255,101 B2
(45) Date of Patent: Feb. 22, 2022

(54) MOBILE TOWER SYSTEM

(71) Applicant: Peak Industries, Inc., Spokane, WA (US)

(72) Inventor: Gerald W. Newman, Spangle, WA (US)

(73) Assignee: Peak Industries, Inc., Spokane, WA (US)

( * ) Notice: Subject to any disclaimer, the term of this patent is extended or adjusted under 35 U.S.C. 154(b) by 0 days.

(21) Appl. No.: 16/822,800

(22) Filed: Mar. 18, 2020

(65) Prior Publication Data

US 2020/0299988 A1 Sep. 24, 2020

Related U.S. Application Data

(60) Provisional application No. 62/820,419, filed on Mar. 19, 2019.

(51) Int. Cl.
*E04H 12/18* (2006.01)
*H01Q 1/32* (2006.01)
*H01Q 1/12* (2006.01)

(52) U.S. Cl.
CPC ..... *E04H 12/182* (2013.01); *H01Q 1/1235* (2013.01); *H01Q 1/3216* (2013.01)

(58) Field of Classification Search
CPC .. H01Q 1/3216; H01Q 1/1135; H01Q 1/1235; E04H 12/182; F21V 21/22; F16M 11/42; F16M 11/26; F16M 11/28; F16M 13/022; B66C 23/36; B66C 23/44
See application file for complete search history.

(56) References Cited

U.S. PATENT DOCUMENTS

| | | | | |
|---|---|---|---|---|
| 33,840 A | | 12/1861 | Hinman | |
| 2,212,561 A | | 6/1939 | Frishcheisen | |
| 5,295,555 A | * | 3/1994 | Strange | E06C 5/04 182/116 |
| 5,658,201 A | * | 8/1997 | Kleimeyer | A63G 27/00 472/27 |
| 7,000,357 B1 | | 2/2006 | Stearns et al. | |
| 7,070,059 B1 | * | 7/2006 | Flowers | B60R 11/00 212/180 |

(Continued)

OTHER PUBLICATIONS

PCT invitation to Pay Additional Fees dated May 15, 2020 for PCT Application No. PCT/US20/23359, 2 pages.

(Continued)

*Primary Examiner* — Andrew J Triggs
(74) *Attorney, Agent, or Firm* — Lee & Hayes, P.C.

(57) ABSTRACT

A mobile tower system includes a tower cassette sized to be accommodated in a bed of a pickup truck. The tower cassette includes a container, a tower vertically fixed to a back portion of the container, and a mounting member fixed to a top of the tower. The mounting member has a free end for mounting a piece of equipment thereto, and the mounting member is moveable between a stowed position and a use position. When in the stowed position, the free end of the mounting member is disposed inside of the container for securing the piece of equipment mounted thereto in the container when the tower is not in use. When in the use position, the free end of the mounting member is disposed outside of the container for operating the piece of equipment when the tower is in use.

13 Claims, 9 Drawing Sheets

(56) References Cited

U.S. PATENT DOCUMENTS

| | | | | |
|---|---|---|---|---|
| 8,467,741 | B2 | 6/2013 | Newman | |
| 9,434,582 | B2 * | 9/2016 | Arthur | B66C 23/00 |
| 9,748,639 | B2 | 8/2017 | Newman | |
| 9,878,676 | B2 * | 1/2018 | Taylor | B66F 7/0666 |
| 9,883,147 | B1 * | 1/2018 | Zaluski | H04N 7/185 |
| 10,063,815 | B1 * | 8/2018 | Spivey | H04N 7/185 |
| 10,103,426 | B2 | 10/2018 | Newman | |
| 2005/0184558 | A1 | 8/2005 | Rigel | |
| 2008/0210416 | A1 | 9/2008 | Lesko | |
| 2010/0250003 | A1 * | 9/2010 | Nieboer | H01Q 1/1235 700/275 |
| 2011/0235303 | A1 * | 9/2011 | Clifton | H01Q 1/1235 361/814 |
| 2017/0254106 | A1 * | 9/2017 | Bruinsma | E04H 12/187 |
| 2018/0201175 | A1 * | 7/2018 | Kennedy | B60D 1/145 |
| 2018/0266637 | A1 * | 9/2018 | Curlett | H01M 10/425 |
| 2018/0273121 | A1 * | 9/2018 | Kennedy | F02B 63/047 |
| 2020/0299988 | A1 * | 9/2020 | Newman | E04H 12/182 |

OTHER PUBLICATIONS

PCT Search Report and Written Opinion dated Jul. 23, 2020 for PCT Application No. PCT/US20/23359, 15 pages.

* cited by examiner

MOBILE TOWER SYSTEM

RELATED APPLICATION

This application claims the benefit of U.S. Provisional Application No. 62/820,419, filed Mar. 19, 2019, and entitled "Mobile Tower System," which is incorporated herein by reference.

BACKGROUND

Pneumatic towers exist that are used in mobile tower systems. For example, pneumatic towers may be installed in a van. However, because these towers are pneumatic they are relatively fragile and prone to failure. For example, the seals (e.g., gaskets, O-rings, etc.) may be relatively fragile and may be prone to fail especially in adverse conditions. Accordingly, there remains a need for mobile tower systems that are more robust.

SUMMARY

Mobile tower systems that are removeably loadable in a bed of a pickup truck are described herein. More specifically, this disclosure relates to mobile tower systems that have tower cassette that is removeably loadable in a bed of a pickup truck. This summary is provided to introduce simplified concepts of mobile tower systems, which are further described below in the Detailed Description. This summary is not intended to identify essential features of the claimed subject matter, nor is it intended for use in determining the scope of the claimed subject matter.

In an embodiment, a mobile tower system includes a tower cassette removeably loadable in a bed of a pickup truck. The tower cassette may include a tower including a base member and a top member vertically aligned with the base member, the top member extendable a vertical distance relative to the base member. The tower cassette may include a hydraulic actuator connected to the top member to extend the top member the vertical distance relative to the base member.

In an embodiment, a mobile tower system includes a tower cassette sized to be accommodated in a bed of a pickup truck. The tower cassette may include a container having a front portion opposite a back portion. When the tower cassette is removeably loaded in the bed of the pickup truck, the front portion of the container may be disposed proximate to a cab of the pickup truck and the back portion of the container may be disposed proximate to a back end of the bed of the pickup truck. The tower cassette may include a tower vertically fixed to the back portion of the container. The tower may be extendable a vertical distance. A mounting member may be fixed to a top of the tower. The mounting member may have a free end for mounting a piece of equipment thereto. The mounting member may be moveable between a stowed position and a use position. When in the stowed position, the free end of the mounting member may be disposed inside of the container for securing the piece of equipment in the container when the tower is not in use. When in the use position, the free end of the mounting member may be disposed outside of the container for operating the piece of equipment when the tower is in use.

Depending on the desired esthetic and mechanical properties of the mobile tower system, and a piece of equipment that the mobile tower system is intended to carry, components may comprise metal, plastic, and/or ceramic.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This disclosure is directed to mobile tower systems having a tower cassette sized to be accommodated in a bed of a pickup truck. Because the tower cassette is sized to be accommodated in a bed of a pickup truck, a user may quickly and easily load the tower cassette in a bed of any pickup truck as desired. Moreover, because the tower cassette is loadable in a bed of a pickup truck, a higher portability of mobile tower systems is achieved as compared to trailered tower systems.

In another example, a mobile tower system includes a hydraulic actuator connected to a top member of a tower. The hydraulic actuator may extend the top member a vertical distance relative to a base member of the tower. Because a hydraulic actuator may extend the top member a vertical distance relative to a base member of the tower, the mobile tower systems may be more robust relative to systems utilizing a pneumatic tower.

Illustrative Mobile Tower Systems

Figure 1:
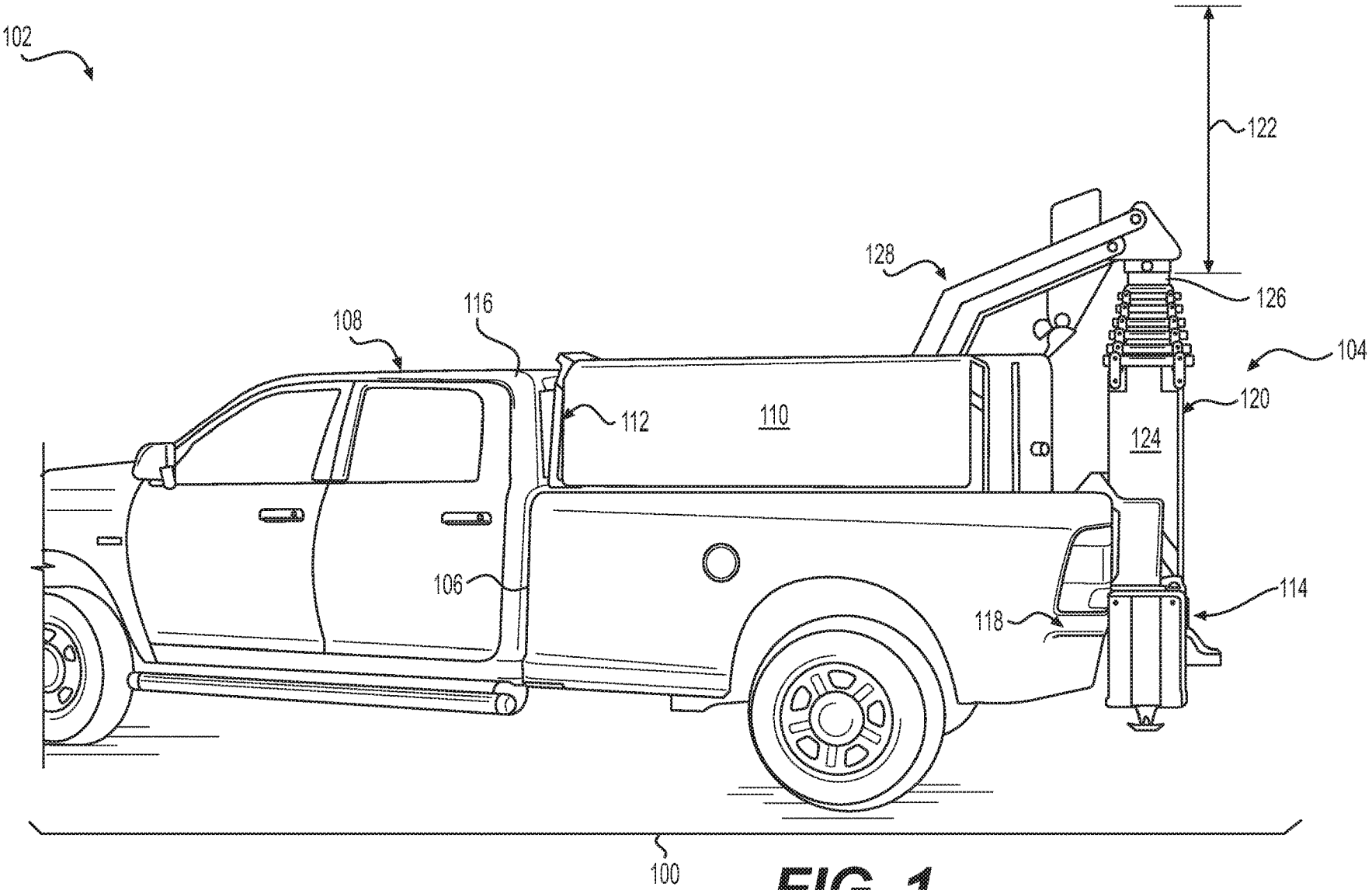
FIG. 1 illustrates a side perspective view of an exemplary mobile tower system with a tower cassette removeably loaded in a bed of a pickup truck according to an embodiment in this disclosure.

FIG. 1 illustrates a side perspective view 100 of an exemplary mobile tower system 102 with a tower cassette 104 removeably loaded in a bed 106 of a pickup truck 108. The tower cassette 104 may include a container 110 having a front portion 112 opposite a back portion 114. The container 110 may include racks fixed on inside surfaces of the container for mounting equipment thereto. For example, radio equipment, wireless equipment, cell equipment, etc. may be mounted to racks fixed on inside surfaces of the container. The container 110 may include one or more doors to provide access to the inside of the container 110 and access to equipment mounted inside the container 100. When the tower cassette 104 is removeably loaded in the bed 106 of the pickup truck 108, the front portion 112 of the container 110 may be disposed proximate to a cab 116 of the pickup truck 108 and the back portion 114 of the container 110 may be disposed proximate to a back end 118 of the bed 106 of the pickup truck 108. The tower cassette 104 may be fastened via mechanical fasteners (e.g., threaded fasteners, clamps, etc.) (not shown) to the bed 106 of the pickup truck 108 and/or to a frame of the pickup truck 108.

A tower 120 may be vertically fixed to the back portion 114 of the container 110. The tower 120 may be extendable a vertical distance 122. For example, the tower 120 may be extendable a vertical distance of about 45 feet. The tower 120 may include a base member 124 and a top member 126. The base member 124 may extend in a length direction and may be oriented such that the length direction extends vertically adjacent to the back portion 114 of the container 110. The top member 126 may be vertically aligned with the base member 124. The top member 126 may be extendable the vertical distance 122 relative to the base member 124. For example, the tower 120 may include a plurality of members vertically aligned between the top member 126 and the base member 124, and the plurality of members and the top member 126 may each extend at least a portion of the vertical distance 122 relative to the base member 124. The top member 126, the base member 124, and the plurality of members may be telescoping segments. Each of the top member 126, the base member 124, and the plurality of members may be rectangular tubes. The top member 126, the base member 124, and/or the plurality of members may be formed of metal (e.g., steel, aluminum, titanium, etc.), composite (e.g., carbon fiber, fiberglass, etc.), plastic, etc.

The tower 120 may utilize shims arranged between the top member 126, the base member 124, and/or the plurality of members. The shims may align each of the members along the longitudinal length of the tower. There may be bottom shims disposed on a bottom portion of a member that slideably engages with an inside surface of another member. There may be top shims disposed on a top portion of a member that slideably engages with an outside portion of another member. The shims may be made of plastic, composite, metal, fiber, etc.

The tower cassette 104 may include an actuator connected to the top member 126 to extend the top member 126 the vertical distance 122 relative to the base member 124. The actuator may be arranged inside of the top member 126 and inside of the base member 124. The actuator may be arranged inside of the plurality of members. The actuator may be a hydraulic actuator. The hydraulic actuator may be a one push hydraulic cylinder. The actuator may be capable of lifting about 5,000 pounds. The tower cassette 104 may include a hydraulic pump attached to a portion of an engine of the pickup truck 108. The portion of the engine of the pickup truck 108 may power the hydraulic pump. The hydraulic pump may power the hydraulic actuator. One or more hydraulic reservoirs and or components may be housed inside of the container 110. The one or more hydraulic reservoirs and or components housed inside of the container 110 may be connected to the hydraulic pump and/or the hydraulic actuator.

The tower cassette 104 may include a mounting member 128 fixed to the top member 126. The mounting member 128 may have a free end for mounting a piece of equipment thereto. The piece of equipment may be a camera, an antenna, a radar, etc. The mobile tower system 102 may utilize the piece of equipment in a security environment, a border patrol environment, a military environment, a wireless environment, a cell cite environment, a micro cell environment, a fast deployment environment (e.g., an emergency environment, a firefighting environment, etc.).

The mounting member 128 may be moveable between a stowed position and a use position. When in the stowed position, the free end of the mounting member 128 may be disposed inside of the container 110 for securing the piece of equipment mounted thereto in the container 110 when the tower 120 is not in use. When in the use position, the free end of the mounting member is disposed outside of the container 110 for operating the piece of equipment when the tower 120 is in use. When the mounting member 128 moves between the stowed position and the use position, the free end of the mounting member 128 may remain level with respect to the tower 120 to keep the piece of equipment mounted to the free end of the mounting member 128 level when the mounting member 128 moves between the stowed position and the use position.

The tower cassette 104 may include a gear arrangement fixed to the mounting member 128 that when actuated moves the mounting member between the stowed position and the use position. The gear arrangement may be a worm drive fixed to the mounting member that when actuated moves the mounting member between the stowed position and the use position.

The tower cassette 104 may include a remote control operable to move the mounting member 128 between the stowed position and the use position. For example, the tower cassette 104 may include a remote control that a user may operate remotely to move the mounting member 128 between the stowed position and the use position. The remote control may be operable to extend the tower 120 the vertical distance 122. For example, a user may operate the remote control to extend the tower 120 the vertical distance 122. The user may operate the remote control to retract the tower 120. The user may operate the remote control to extend the tower 120 to any vertical distance less than the vertical distance 122.

Figure 2:
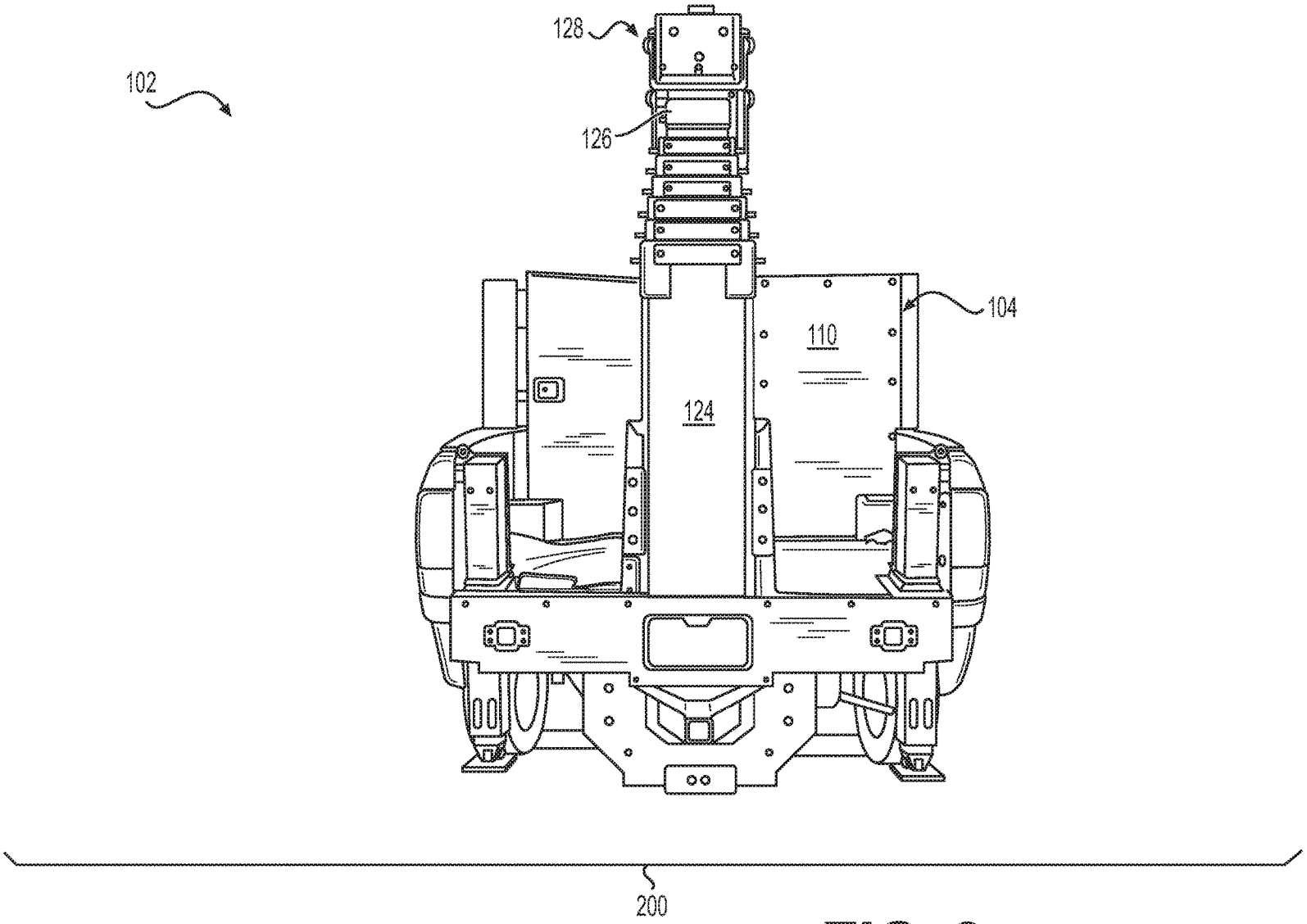
FIG. 2 illustrates a back perspective view of the mobile tower system of FIG. 1 according to an embodiment in this disclosure.

FIG. 2 illustrates a back perspective view 200 of the mobile tower system 102 of FIG. 1 according to an embodiment in this disclosure. FIG. 2 illustrates the tower cassette 104 may include the mounting member 128 fixed to the top member 126. As discussed above, the base member 124 may extend in a length direction and may be oriented such that the length direction extends vertically adjacent to the back portion 114 of the container 110. The top member 126 may be vertically aligned with the base member 124.

Figure 3:
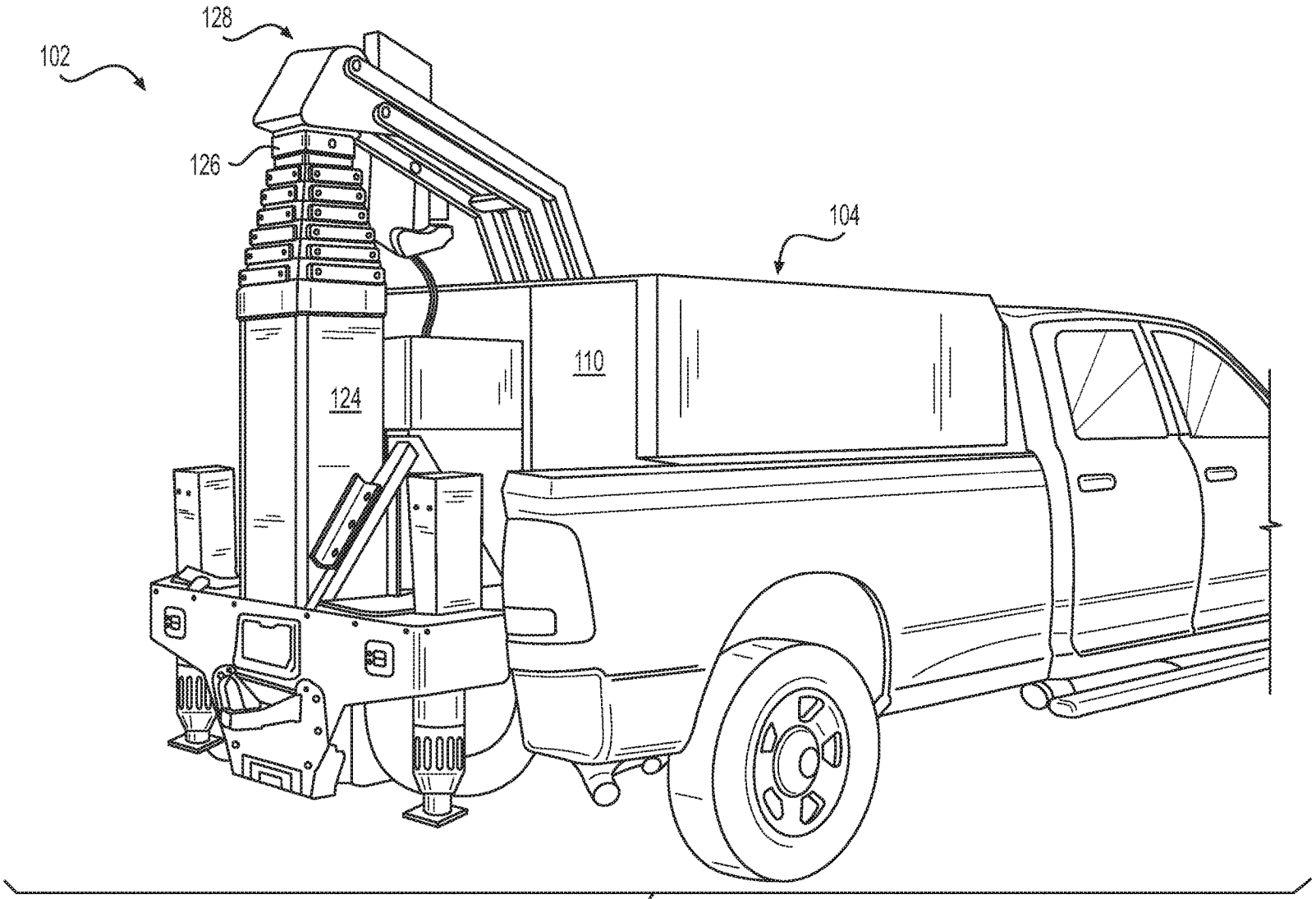
FIG. 3 illustrates another back perspective view of the mobile tower system of FIG. 1 according to an embodiment in this disclosure.

FIG. 3 illustrates another back perspective view 300 of the mobile tower system 102 of FIG. 1 according to an embodiment in this disclosure.

Figure 4:
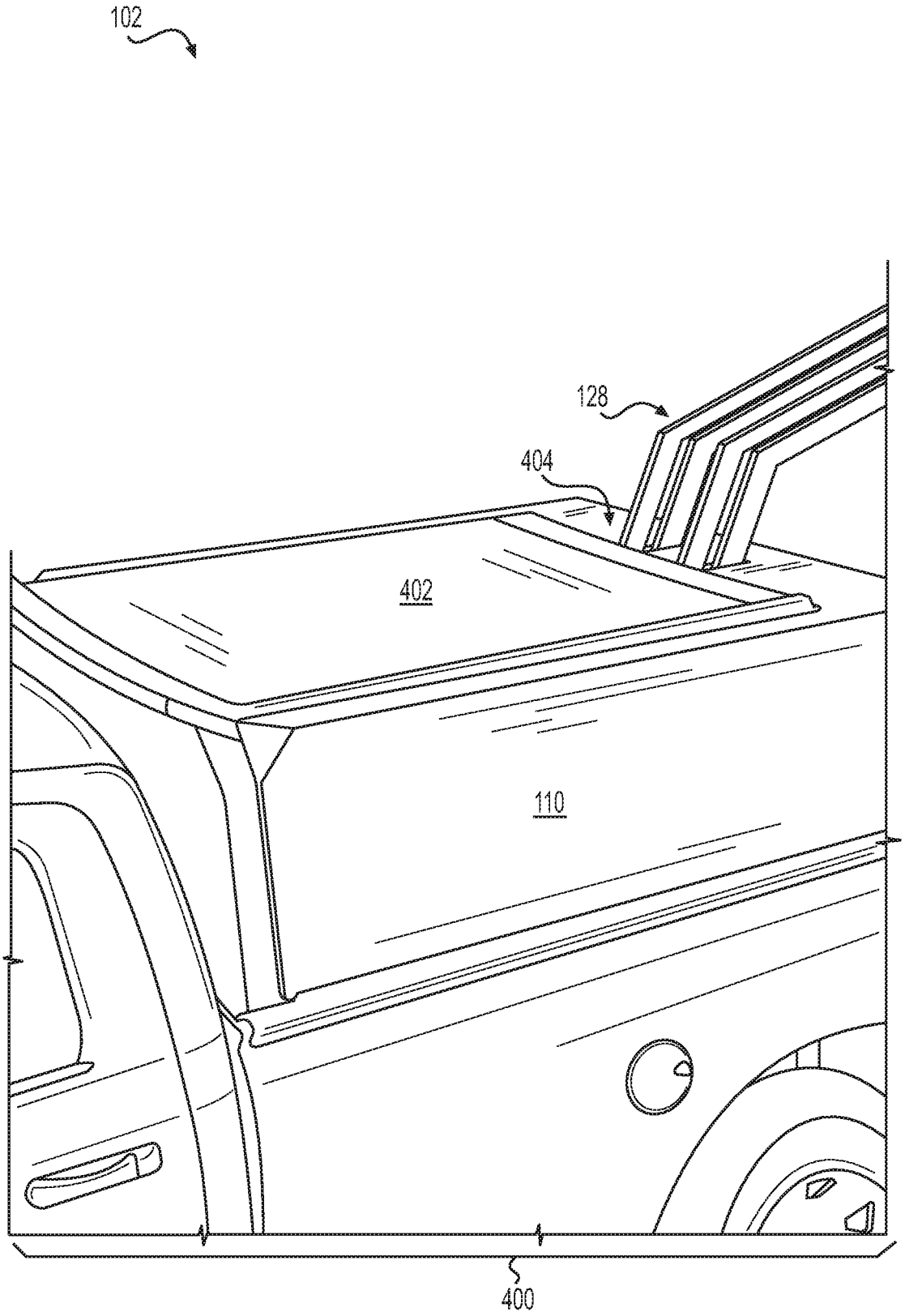
FIG. 4 illustrates a top perspective view of the mobile tower system of FIG. 1 with a cover in a closed position according to an embodiment in this disclosure.

FIG. 4 illustrates a top perspective view 400 of the mobile tower system 102 of FIG. 1 with a cover 402 in a closed position according to an embodiment in this disclosure. FIG. 4 illustrates the cover 402 may be disposed in a top portion of the container 110. The cover 402 may be moveable between the closed position and the open position. For example, the cover 402 may be slideably displaced along the top portion of the container 110 between the closed position and the open position. When in the closed position, the cover 402 seals an opening in the top portion of the container 110 to secure a piece of equipment mounted to the free end of the mounting member 128 in the container 110 when the tower 120 is not in use. The top portion of the container 110 may include one or more openings 404 sized to removeably receive at least a portion of the mounting member 128 when the mounting member is in the stowed position.

Figure 5:
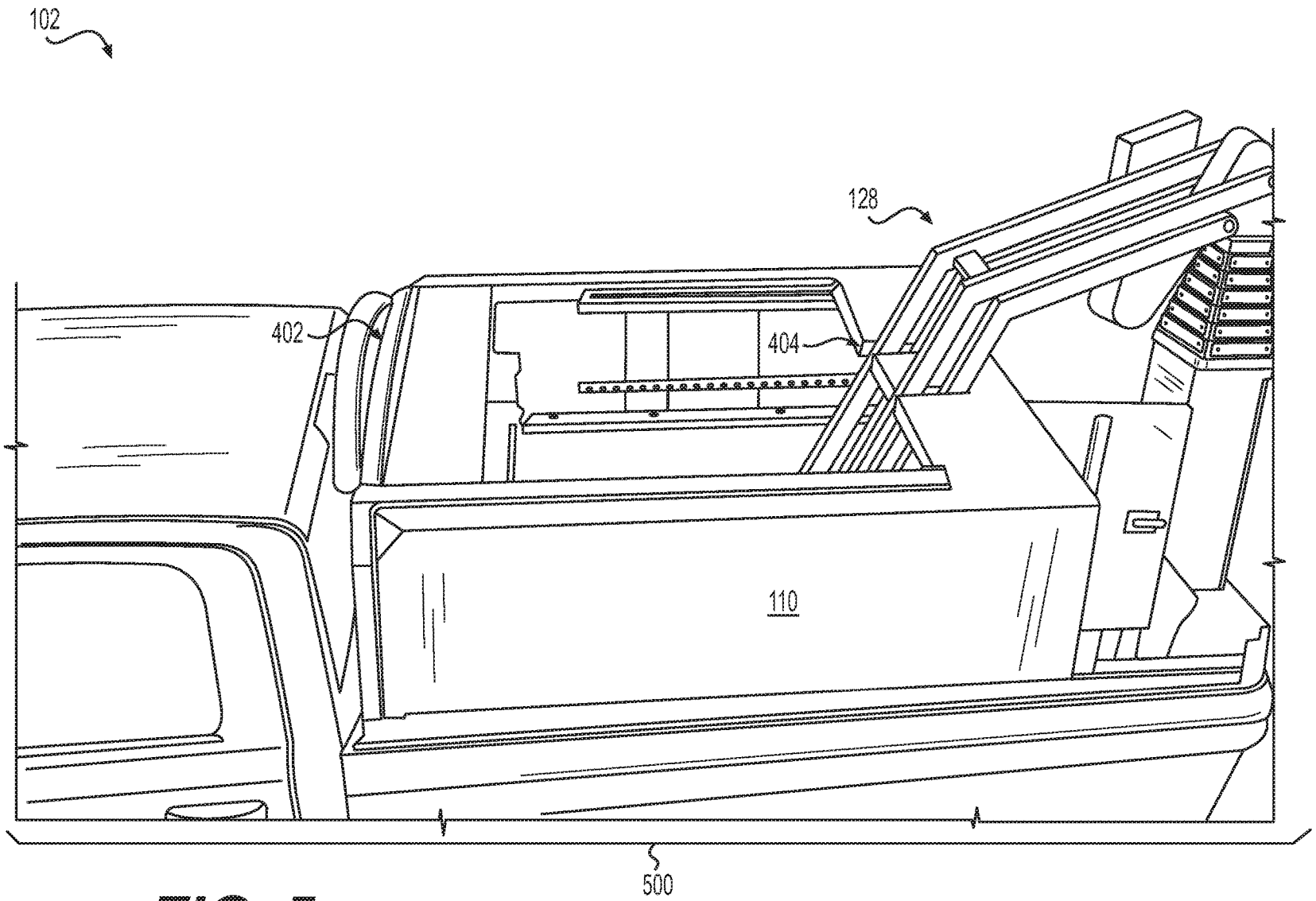
FIG. 5 illustrates a top perspective view of the mobile tower system of FIG. 1 with the cover in an open position according to an embodiment in this disclosure.

FIG. 5 illustrates a top perspective view 500 of the mobile tower system 102 of FIG. 1 with the cover 402 in the open position according to an embodiment in this disclosure. Prior to moving the mounting member 128 from the stowed position to the use position, the cover 402 may be moved from the closed position illustrated in FIG. 4 to the open position illustrated in FIG. 5. The tower cassette 104 may include a remote control operable to move the cover between the open position and the closed position.

Figure 6:
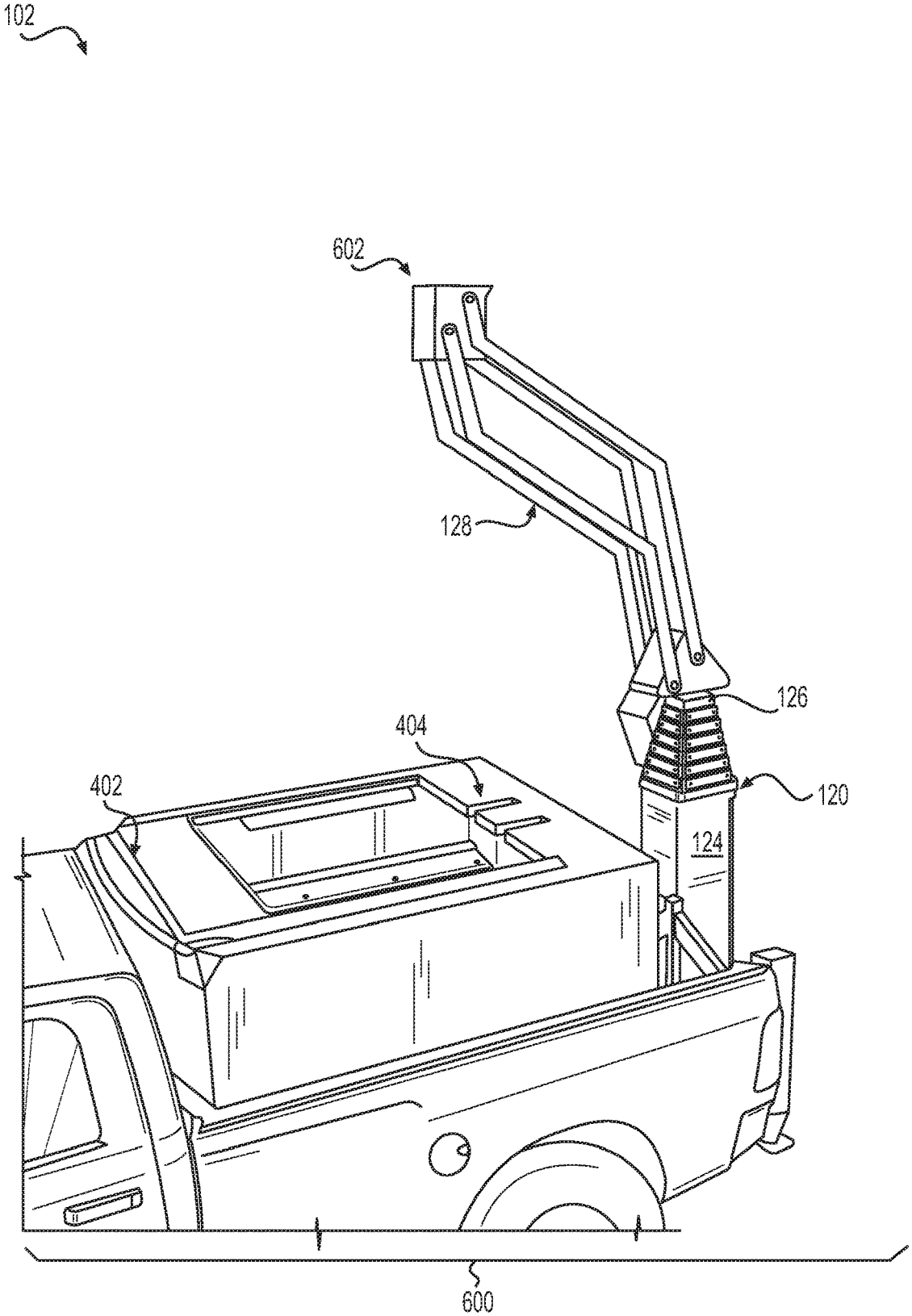
FIG. 6 illustrates a top perspective view of the mobile tower system of FIG. 1 with a mounting member in a use position according to an embodiment in this disclosure.

FIG. 6 illustrates a top perspective view 600 of the mobile tower system 102 of FIG. 1 with the mounting member 128 in a use position according to an embodiment in this disclosure. FIG. 6 illustrates the mounting member 128 fixed to the top member 126. The mounting member 128 may have a free end 602 for mounting a piece of equipment thereto. The mounting member 128 may include a framework of a plurality of bars and/or tubes. For example, the mounting member 128 may include a framework of a plurality of rectangular bars, rectangular tubes, circular bars, circular tubes, etc. One or more of the plurality of bars and/or tubes may be formed of metal, composite, plastic, etc. The framework of the plurality of bars and/or tubes may be fixed together such that when the framework of the plurality of bars and/or tubes moves between the stowed position and the use position, the free end 602 remains level with respect to the tower 120 to keep the piece of equipment mounted to the free end 602 level when the framework of the plurality of bars and/or tubes moves between the stowed position and the use position. The gear arrangement may be fixed to the framework of the plurality of bars and/or tubes to move the plurality of bars and/or tubes between the stowed position and the use position. The gear arrangement may be fixed to the framework of the plurality of bars and/or tubes proximate to a top portion of the top member 126.

Subsequent to the moving of the mounting member 128 from the stowed position to the use position, the tower 120 may be extended the vertical distance 122. A user may use the remote control to move the cover 402 from the closed position to the open position, move the mounting member from the stowed position to the use position, and extend the tower 120 the vertical distance 122.

Figure 7:
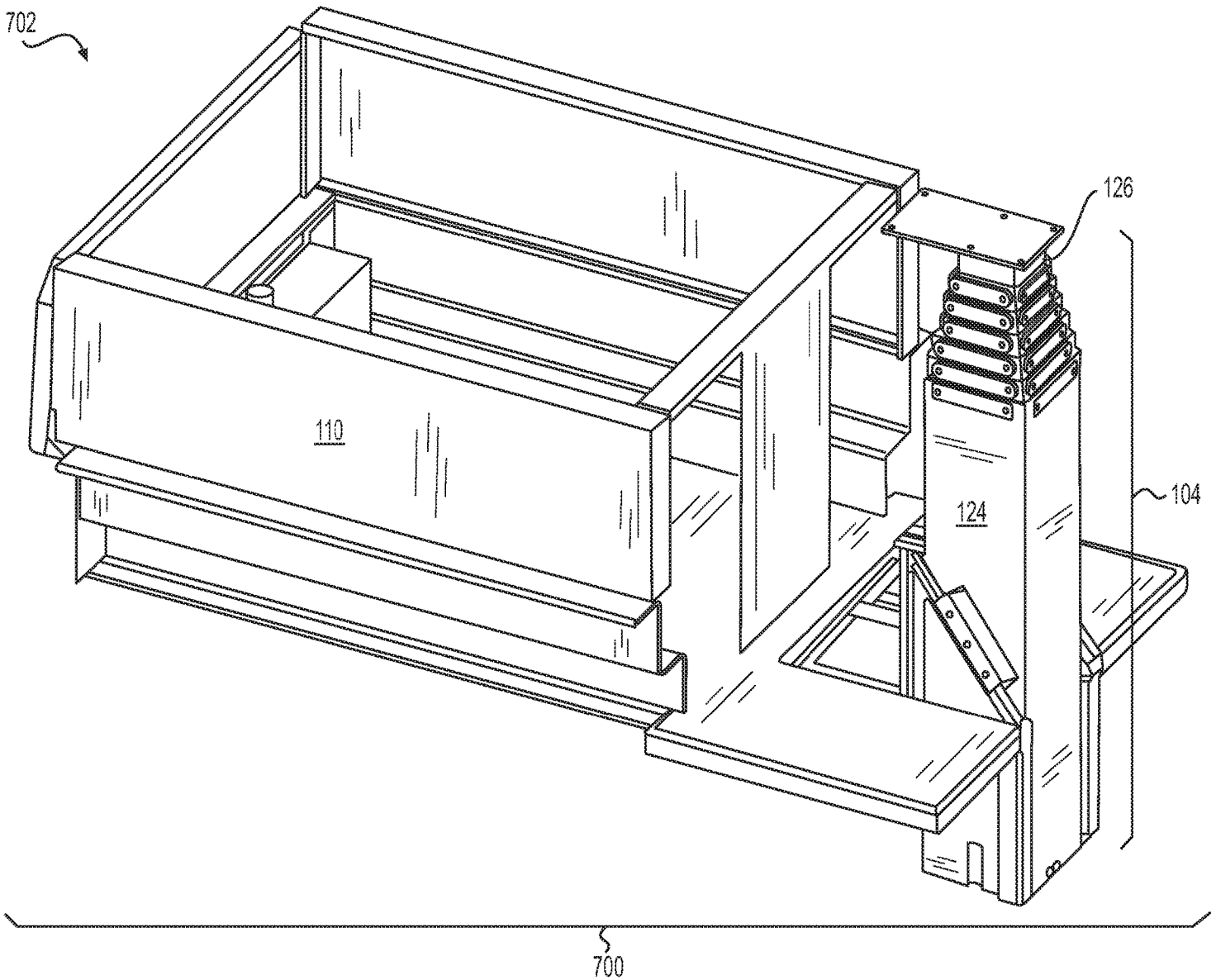
FIG. 7 illustrates a top perspective view of an exemplary tower cassette according to an embodiment in this disclosure.

FIG. 7 illustrates a top perspective view 700 of an exemplary tower cassette 702 according to an embodiment in this disclosure. The tower cassette 702 may be the same as the tower cassette 104. The tower cassette 702 may be removeably loaded in the bed 106 of the pickup truck 108. The tower cassette 702 may include the same elements and features as the tower cassette 104. For example, tower cassette 702 may include the container 110 and the tower 120.

Figure 8:
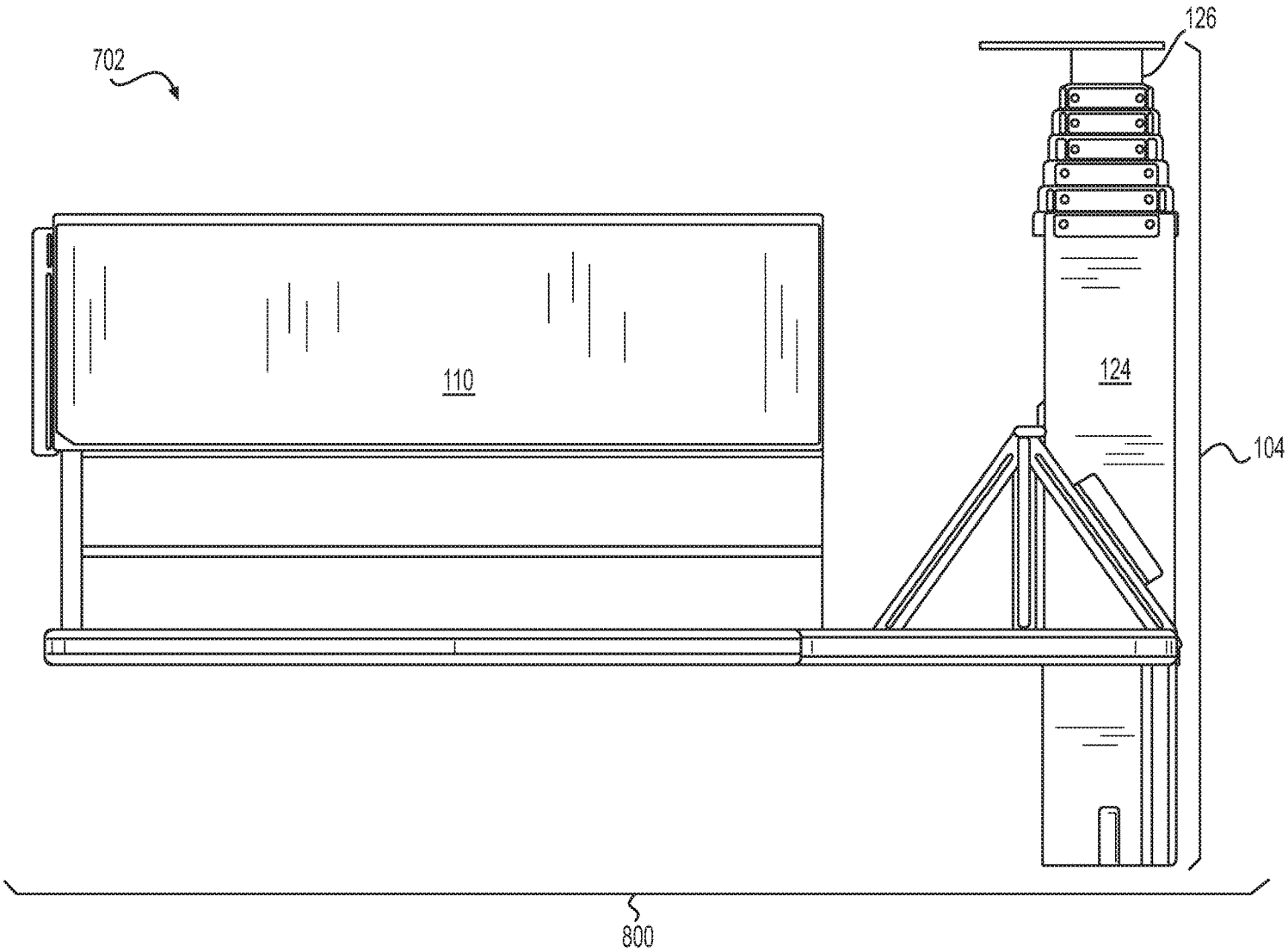
FIG. 8 illustrates a side view of the tower cassette shown in FIG. 7 according to an embodiment in this disclosure.

FIG. 8 illustrates a side view 800 of the tower cassette 702 shown in FIG. 7 according to an embodiment in this disclosure.

Figure 9:
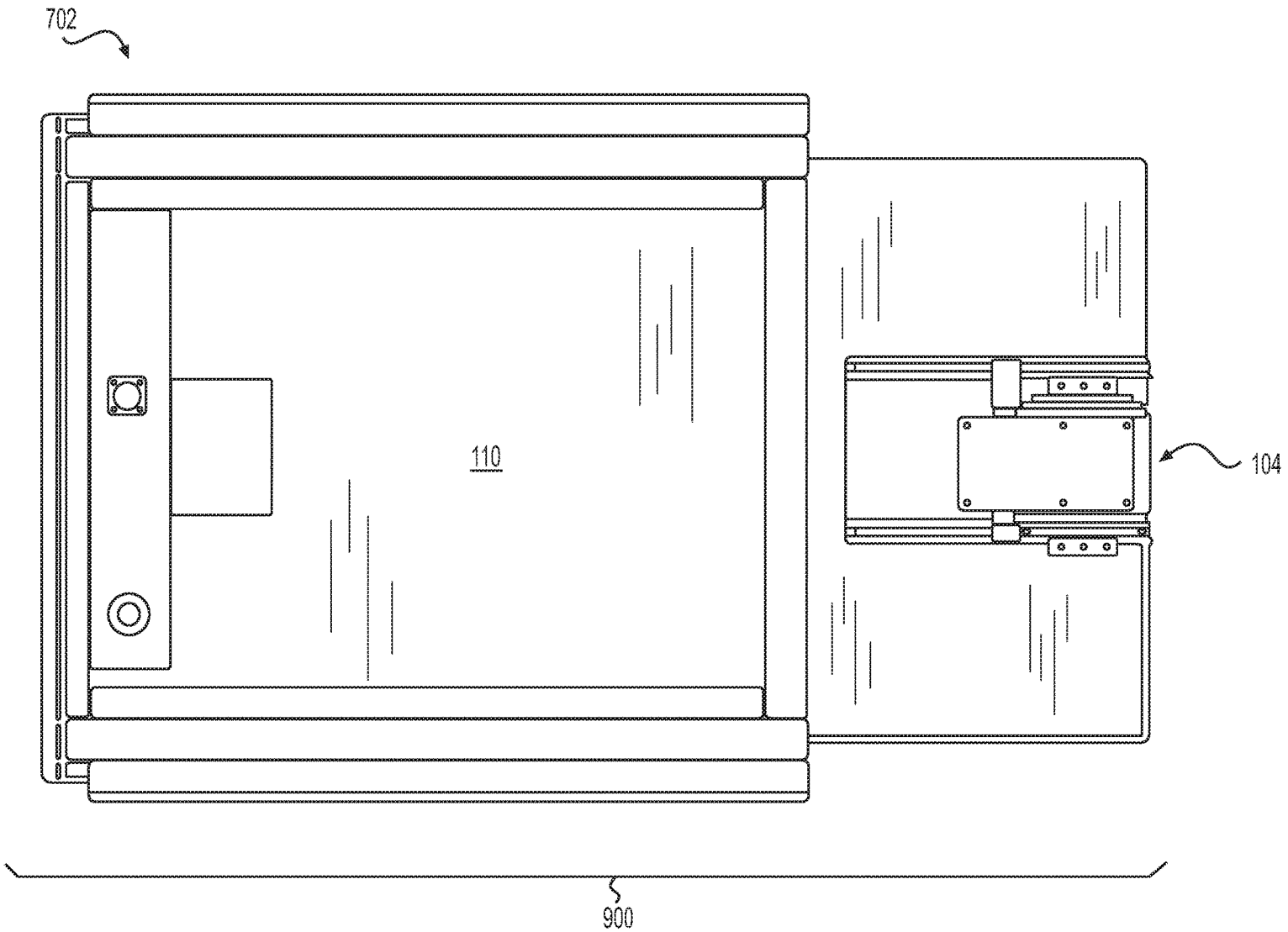
FIG. 9 illustrates a top view of the tower cassette shown in FIG. 7 according to an embodiment in this disclosure.

FIG. 9 illustrates a top view 900 of the tower cassette 702 shown in FIG. 7 according to an embodiment in this disclosure.

CONCLUSION

Although the invention has been described in language specific to structural features and/or methodological acts, it is to be understood that the invention is not necessarily limited to the specific features or acts described. Rather, the specific features and acts are disclosed as illustrative forms of implementing the invention. For example, while embodiments are described having certain shapes, sizes, and configurations, these shapes, sizes, and configurations are merely illustrative.

What is claimed is:

1. A mobile tower system comprising:

a tower cassette sized to be accommodated in a bed of a pickup truck, the tower cassette including:

a container having a front portion opposite a back portion, when the tower cassette is removeably loaded in the bed of the pickup truck, the front portion of the container is disposed proximate to a cab of the pickup truck and the back portion of the container is disposed proximate to a back end of the bed of the pickup truck;

a tower vertically fixed to the back portion of the container, the tower being extendable a vertical distance; and a mounting member fixed to a top of the tower, the mounting member having a free end for mounting a piece of equipment thereto, and the mounting member moveable between a stowed position and a use position, wherein when in the stowed position the free end of the mounting member is disposed inside of the container for securing the piece of equipment mounted thereto in the container when the tower is not in use, and wherein when in the use position the free end of the mounting member is disposed outside of the container for operating the piece of equipment when the tower is in use.

2. The mobile tower system of claim 1, wherein when the mounting member moves between the stowed position and the use position, the free end of the mounting member remains level with respect to the tower to keep the piece of equipment level when the mounting member moves between the stowed position and the use position.

3. The mobile tower system of claim 1, wherein the tower cassette further includes:

a hydraulic actuator that when actuated extends the tower the vertical distance; and a hydraulic pump attachable to an engine of the pickup truck, the hydraulic pump to power the hydraulic actuator.

4. The mobile tower system of claim 1, wherein the tower cassette further includes a cover disposed in a top portion of the container, wherein the cover is moveable between a closed position and an open position, wherein when in the closed position the cover seals an opening in the top potion of the container to secure the piece of equipment mounted to the free end of the mounting member in the container when the tower is not in use.

5. The mobile tower system of claim 4, wherein the tower cassette further includes a remote control operable to:

move the cover between the open position and the closed position;

move the mounting member between the stowed position and the use position; or extend the tower the vertical distance.

6. The mobile tower system of claim 1, wherein the tower cassette further includes a worm drive fixed to the mounting member that when actuated moves the mounting member between the stowed position and the use position.

7. A method of erecting a mobile tower system comprising:

utilizing a tower cassette removeably loaded in a bed of a pickup truck, the tower cassette including:

a container having a front portion opposite a back portion, the front portion of the container disposed proximate to a cab of the pickup truck and the back portion of the container is disposed proximate to a back end of the bed of the pickup truck;

a tower vertically fixed to the back portion of the container, the tower being extendable a vertical distance; and a mounting member fixed to a top of the tower, the mounting member having a free end for mounting a piece of equipment thereto, and the mounting member moveable between a stowed position and a use position;

moving the mounting member from the stowed position to the use position.

8. The method of erecting the mobile tower system as recited in claim 7, further comprising, subsequent to the moving of the mounting member from the stowed position to the use position, extending the tower the vertical distance.

9. The method of erecting the mobile tower system as recited in claim 7, wherein the tower cassette further includes a cover disposed in a top portion of the container, wherein the cover is moveable between a closed position and an open position, wherein when in the closed position the cover seals an opening in the top portion of the container to secure the piece of equipment mounted to the free end of the mounting member in the container when the tower is not in use; and the method of erecting the mobile tower system further comprising, prior to moving the mounting member from the stowed position to the use position, moving the cover from the closed position to the open position.

10. The method of erecting the mobile tower system as recited in claim 7, wherein the moving of the mounting member from the stowed position to the use position includes the free end of the mounting member remaining level with respect to the tower to keep the piece of equipment level during the moving of the mounting member from the stowed position to the use position.

11. The method of erecting the mobile tower system as recited in claim 7, wherein the tower cassette further includes an actuator that when actuated extends the tower the vertical distance; and the method of erecting the mobile tower system further comprising, actuating the actuator.

12. The method of erecting the mobile tower system as recited in claim 11, wherein the actuator is a hydraulic actuator, and the tower cassette further including a hydraulic pump attached to an engine of the pickup truck, the hydraulic pump to power the hydraulic actuator.

13. The method of erecting the mobile tower system as recited in claim 7, wherein the tower cassette further includes a remote control operable to cause the moving of the mounting member from the stowed position to the use position.

* * * * *